United States Patent [19]

Williams et al.

[11] 4,108,760

[45] Aug. 22, 1978

[54] EXTRACTION OF OIL SHALES AND TAR SANDS

[75] Inventors: Derek Farnham Williams, London; Terence Geoffrey Martin, Winchcombe, both of England

[73] Assignee: Coal Industry (Patents) Limited, London, England

[21] Appl. No.: 598,653

[22] Filed: Jul. 24, 1975

[30] Foreign Application Priority Data

Jul. 25, 1974 [GB] United Kingdom ..... 32892/74

[51] Int. Cl.[2] ..... C10G 1/04

[52] U.S. Cl. ..... 208/11 LE; 208/11 R

[58] Field of Search ..... 208/11 LE, 11 R

[56] References Cited

U.S. PATENT DOCUMENTS

| | | | |
|---|---|---|---|
| T700,485 | 4/1969 | Hemminger et al. | 208/8 |
| T700,489 | 4/1969 | Long et al. | 208/11 LE |
| 2,487,788 | 11/1949 | Buchan | 208/11 LE |
| 2,665,238 | 1/1954 | Truitt et al. | 208/11 LE |
| 2,670,317 | 2/1954 | Adams | 208/11 LE |
| 3,695,354 | 10/1972 | Dilgren et al. | 208/11 LE |
| 3,850,738 | 11/1974 | Stewart et al. | 208/11 LE |
| 3,929,193 | 12/1975 | Duke | 208/11 LE |
| 3,948,755 | 4/1976 | McCollum et al. | 208/11 LE |

*Primary Examiner*—Herbert Levine

*Attorney, Agent, or Firm*—Stevens, Davis, Miller & Mosher

[57] ABSTRACT

This invention relates to the extraction of oil shales and tar sands by using a solvent under supercritical conditions at a temperature within 200° C. or its critical temperature in order to effect extraction of kerogen from the sand or shale.

In the case of shales considerable heat needs to be applied to the shale before effective extraction can occur and extraction in this case may be carried out at a temperature within the range of 370° to 450° C.

17 Claims, No Drawings

EXTRACTION OF OIL SHALES AND TAR SANDS

The present invention relates to the extraction of oil shales and tar sands.

Tar sands and oil shales represent two of the major world resources of oil. Exploitation of these resources has been limited by the previously low priced and abundant supply of liquid crude oil and the process difficulties of winning the heavier, more viscous organic materials from rock ores.

Most of the alternative technologies of exploitation are based on mining as the initial operation, although it has been proposed to inject steam in situ for extraction of the Athabasca Tar Sands, and it has also been proposed to conduct underground retorting of oil shales after a limited amount of mining.

The extraction of oil from tar sands, however, requires a physical separation process to break the oil/-sand bonds. This can be achieved using hot water, steam and a diluent. Such a process is presently being conducted at the Great Canadian Oil Sands Plant in Canada. Oil shale, on the other hand, is an impervious rock which must be heated to a temperature of greater than 370° C. to break the chemical bonds between the organic matter (sometimes referred to as "kerogen") and the shale, to convert the former into liquid oil. About 700,000 Btu of heat is needed to retort a ton of shale. In this prior process, this heat is provided by combustion of the product of gases or of the carbon in the residual shale, either within the retort itself or in a separate vessel. In a typical example, crushed shale is heated with hot ceramic balls at a temperature of the order of 550° C. and produces approximately 252 lbs. of oil and 42 lbs. of hydrocarbon gases per ten of shale. It has also been proposed to heat the shale and to hydrogenate at the same time using hydrogen at moderate pressures.

The crude oil produced from both the tar sands and the oil shales requires further processing to convert it into an acceptable refinery feedstock. The tar sands crude is a heavy, extremely viscous high sulphur crude which must be coked and hydrogenated or alternatively hydrocracked. The oil recovered from shale retorts is similar to conventional crudes in some respects, it possesses a very high nitrogen content and is again extremely viscous. Further processing could involve distillation, coking of the residue and/or hydrogenation.

According to the present invention, however, there is provided a process for the extraction of oil shales and tar sands which process comprises heating the shale in the presence of an extractant gas at a temperature of within the range 0° to 550° C. to extract extractable constituents, separating the extractant and extract from the residue, recovering the extract from the extractant and recycling the extractant, wherein the extractant has a pressure not less than its critical pressure and wherein at the extraction temperature, the extractant is above its critical temperature by not more than 200 centigrade degrees.

The present invention also includes a process for the extraction of oil shales and tar sands which process comprises heating the shale in the presence of an extractant in the gas phase at a temperature within the range 350° to 550° C. to extract extractable constituents, separating the extractant and extract from the residue, recovering the extract from the extraction and recycling the extractant for further use. The extraction is preferably carried out at a temperature within the range of 370° to 450° C. and the shale is preferably crushed to a size smaller than 1.5 mm.

The solvent/shale ratio may be within the range 1/1 to 30/1 and is preferably within the range of 2/1 to 10/1. The extraction pressure should be above the critical pressure and may be within the range of 500 to 10,000 psi and preferably within the range of 1000 to 3000 psi.

The oil material in the oil shales and tar sands, often known as "kerogen," can be driven off by retorting. In oil shales in particular, it is necessary to heat to above 350° C. in order to commence decomposition so that extraction can take place using appropriate extractants. In the case of the tar sands, extraction can be effected at much lower temperatures, even as low as 80°-100° C. using the extraction conditions in accordance with the present invention.

The rate of heating is not critical and in consequence the extraction step can be carried out in a vessel operated at a constant temperature. Typically the extraction vessel may comprise a fluidised bed system. The extract and extractant may be removed from the shale, sand or residue as soon as possible after extraction in order to minimise any repolymerisation reaction.

The extractant may comprise a solvent or utilisable solvent component which at the extraction temperature is above its critical temperatures. The extraction is carried out at a pressure such that the sum of the reduced partial pressures of the solvent components is at least 1, and the solvent components themselves, preferably have a critical temperature of greater than 150° C. The utilisable solvent component may be hydrocarbons or organic derivatives of hydrocarbons and other organic compounds which solvent components have a critical temperature of above about 150° C. and in practice preferably have a critical temperature of below 450° C. The critical temperature of such utilisable solvent components is preferably greater than 300° and below 400° C. Thus, at the terminal temperature, these extractant or solvent components will clearly be in the gaseous stage and will act as a gas and not as a vapour, that is to say, under the temperature conditions which exist during extraction, the gas will not be capable of liquefaction by the application of pressure alone.

Under the extraction conditions, therefore, it is clear that the utilisable solvent components should be stable at the terminal temperature and that they should not decompose appreciably below the terminal temperature and, furthermore, it is preferred that they should not react with the shale or sand under the conditions of extraction. There is no external hydrogen supplied. In one aspect of the invention, however, at least some of the utilisable solvent components may be partially decomposed or react with the shale or sand under the conditions of extraction, in which case it will be appreciated that the possibility of limited hydrogenation of the hydrocarbons within the shale or sand may take place. If any hydrogen is present in the extractant during the extraction, then certain aromatic compounds, particularly polycyclic aromatic compounds may be hydrogenated under the conditions encountered. The hydrogenated compounds may then act as hydrogen donors reacting with the hydrocarbon substance and degradation products thereof, to donate hydrogen thereto to produce an improved yield of hydrogenated products from the shale or sand.

The reduced partial pressure of any such utilisable solvent components is its partial pressure Pi at the extraction temperature relative to the critical pressure $P_{ci}$ that is to say, $P_i/P_{ci}$.

As stated above, the sum of the reduced partial pressures of the utilisable solvent components which are above their critical temperatures at the extraction temperature should be at least 1. This is equivalent, in the case of the single substance solvent, to specifying that the single substance solvent is above its critical pressure. A single solvent can be employed as an extractant but in a process carried out on a commercial scale, it is more convenient and economic to employ a mixture of solvents. If the solvent contains a significant proportion of the substances with critical temperatures above the extraction temperature, a proportion at least of the substance may dissolve in the super-critical portion of the solvent. A portion of the substance whose critical temperature is above the extraction temperature may further remain in the liquid phase; this, in itself is not detrimental to the practice of the present invention, but there may be some difficulty in recovering the liquified portion of the solvent.

The solvents that may be employed as extractants in the process of the present invention need not necessarily be completely stable up to the maximum extraction temperature of 550° C. neither need they have critical temperatures within the ranges stated, but it has been found that solvents which fulfil these criteria tend to be more effective.

Suitable solvents include aromatic hydrocarbons having a single benzene ring and preferably not more than 4 carbon atoms in substituent groups, for example, benzene, toluene, xylene, ethyl benzene, iso-propyl benzene and tri- and tetra- methyl benzenes. Thus, virtually the whole of the bitumen in tar sands can be extracted with benzene at or above 290° C. or with toluene above 320° C. A very high proportion of the kerogen in oil shales, particularly those shales such as Colorado shales which release all their kerogen on heating, can be extracted with aromatics containing 2–4 carbon atoms in substituent groups at about 440° C.

Aromatic hydrocarbons having two aromatic rings may also be used as solvent components, although it should be noted that their critical temperatures are relatively high; these compounds include, for example, naphthalene, methyl naphthalene, biphenyl and biphenyl methane.

Alicyclic hydrocarbons may also be employed, preferably those having at least five carbon atoms such as cyclopentane, cyclohexane, cis- and transdecalin and alkylated derivatives thereof. Alicyclic hydrocarbons having a total of more than 12 carbon atoms are less effective. A high-naphthenic fraction of kerocene has been found to be particularly effective in extracting oil shales at 400°–450° C.

Aliphatic hydrocarbons having at least five carbon atoms but not more than 16 carbon atoms may also be employed, for example pentanes, hexanes, octanes, dodecanes and hexadecanes, though these are not as effective as aromatic solvents, particularly for the recovery of asphaltenes. Such aliphatic hydrocarbons, particularly if hydrogen is present concurrently with extraction, are preferably saturated, as the corresponding alkenes may be at least partially hydrogenated or alkylated or otherwise subjected to polymerisation under the conditions of extraction. It is also preferred to use relatively straight chain hydrocarbons, since hydrocarbons having long branched chains are more likely to be subjected to molecular rearrangement and cross alkylation reactions under the conditions of the extraction. Such molecular rearrangements and cross-alkylation reactions can also occur in the case of alkyl substituted aromatic hydrocarbons. The molecular rearrangements and cross-alkylation reactions may be catalysed by Friedel-Crafts catalysts which may be present in the sand or shale bed in small quantities.

Phenols, preferably those derived from aromatic hydrocarbons having up to eight carbon atoms may be employed, for example phenol, anisole and xylenols, although the phenolic group may be liable to be eliminated under the extraction conditions.

Many other oxygen-containing compounds may be employed in the extraction including alcohols, aldehydes, ketones, ethers and esters. If hydrogen is present, many of these compounds may be reduced under the extraction conditions and their use in large proportions as solvent components would not be desirable in those circumstances. Furthermore, such oxygen-containing compounds are liable, in the presence of catalysing impurities in the tar and shale to react with the tar or shale or other compounds to produce gases or alternatively may be subjected to molecular rearrangement, and in such circumstances this may affect the amount of solvent available for recycling in the process. However, tetrahydrofuran is an excellent solvent for tar sands at 270°–300° C., and acetone is also a useful solvent component over the range 240°–300° C. Water may also be used as a solvent component.

Nitrogen-containing organic compounds may also be used in the solvent, such amines including aliphatic mono-, di-, and tri- amines which have at least 4, and preferably at least 6 carbon atoms. It is preferred, however, not to employ amines having more than 10 carbon atoms. The amines may be acyclic aliphatic amines, for example, tri-ethylamine and di-propylamine, while aromatic amines having a benzene ring may also be employed, for example aniline, N-methyl aniline, N,N-dimethylaniline, toluidene and N-methyl toluidine. However, heterocyclic amines are the preferred nitrogen-containing solvents, for example, pyridine, methyl pyridines and dimethylpyridines. Pyridine is particularly effective in the extraction of oil shales at 400°–450° C.

Halogen-containing organic compounds such as chloroform, carbon tetrachloride, methylene chloride and chlorobenzene may be employed, but the instability of the aliphatic chlorides mentioned, in the presence of water, should be borne in mind.

Some sulphur compounds such as alkyl thiophenes may also be employed. Carbon disulphide is effective but tends to be unstable.

In view of the comparatively high cost of the solvent components of the extractant it is preferred that the solvent components be recovered and recycled in a commercial process. The process itself may be conducted either as a batch process or as a continuous extraction process. In a commercial plant, a continuous process is preferable. In a typical process, the shale and sand is contacted with the solvent and is heated rapidly to the extraction temperature, and maintained at that temperature in which the shale is passed countercurrent to the heated extractant at the terminal temperature. In the alternative, a fluidised bed arrangement may be effected.

An initial heating zone may be employed comprising a plurality of zones to produce progressive heating of the shale and sand in the presence of the extractor. The extraction zone may also comprise a plurality of zones, typically four fluidized beds having temperatures of say 395°, 410°, 420° and 430° C. may be employed and such an arrangement would allow for relatively longer retention time at the maximum temperature. The shale of sand and the solvent are preferably mixed at atmospheric pressure and at ambient temperatures. This permits easier mechanical handling if pressures greater than atmospheric are employed. As, however, it is usual to recycle the solvent, initial solvent temperatures of the order of 150° C. or more may be employed during the initial mixing.

As stated above, the ratio of solvent, shale or sand may be maintained at a low value, say, below 10 - 1 for economic reasons. On the other hand, the use of greater solvent to shale or sand ratios produces more complete extraction. This is a normal effect in solvent extraction processes.

Although the sand itself need not be crushed, it is preferred, as stated above, that the particle size of the material to be extracted should be less than 1.5 mm.

By way of example a number of shales were analysed and then subjected to extraction in accordance with the present invention. The materials subjected to extraction were as follows:

Colorado Oil Shale
Scottish Oil Shale
Athabasca Tar Sands

Before commencing extraction a sample of each material was analysed and the results are as set out in Table 1.

TABLE 1

| | Ultimate analyses of oil shales and tar sands | | | | | | | | |
|---|---|---|---|---|---|---|---|---|---|
| | % $H_2O$ ar | % Ash db | % dry basis C | H | O | N | S | Cl | $CO_2$ |
| Colorado Oil Shale | 0.5 | 60.6 | 17.5 | 2.4 | 1.0 | 0.55 | 0.90 | NIL | 17.1 |
| Scottish Oil Shale | 1.9 | 69.8 | 21.5 | 2.9 | 3.7 | 0.55 | 1.10 | NIL | 0.43 |
| Athabasca Tar Sands | 2.9 | 89.1 | 8.3 | 0.9 | 1.2 | 0.10 | 0.45 | NIL | 0.04 |

Gray-King assayes of the oil shales and tar sands was then carried out on a dry basis and as a gas analysis. The results are as shown in Table 2 and 3.

TABLE 2

| | Gray-King assays of oil shales and tar sands | | | | |
|---|---|---|---|---|---|
| | ANALYSES % wt dry basis | | | | Gas Vol. mls/100g of sample |
| | Coke | Tar | Liquor | Gas | (db) |
| Colorado Oil Shale | 79.9 | 14.8 | 0.8 | 3.2 | 3190 |
| Scottish Oil Shale | 79.3 | 14.8 | 2.8 | 2.3 | 2280 |
| Athabasca Tar Sands | 90.5 | 8.4 | 0.5 | 0.8 | 620 |

TABLE 3

| | Gray-King assay gas analyses | | | | | |
|---|---|---|---|---|---|---|
| | $H_2$ | $O_2$ | $N_2$ | $CH_4$ | CO | $CO_2$ |
| Colorado Oil Shale | 41.0 | — | — | 26.3 | 7.1 | 25.6 |
| Scottish Oil Shale | 38.9 | — | — | 38.2 | 4.0 | 18.9 |
| Athabasca Tar Sands | 11.0 | — | — | 10.1 | 0.0 | 78.9 |

In each case extraction was conducted by the use of toluene, pentane or acetone at temperatures within the range of 350° to 550° C. and at pressures of 1500 psi. The residue and the extract were collected and subjected to analysis. Table 4 shows Examples 1 to 5 with analysis details.

TABLE 4

| | | Gas extraction data and product yields | | | | | | |
|---|---|---|---|---|---|---|---|---|
| Example No. | Charge | Solvent | Temp. (° C.) | Extraction/ Time (mins.) | Solvent/ dry coal ratio | Solvent Flow (g/ min) | %Yield extract db | %Yield Residue db |
| 1 | Colorado Oil Shale | Toluene | 395 | 60 | 20.3 | 31.6 | 16.6 | 82.3 |
| 2 | " | Toluene | 440 | 60 | 18.1 | 28.1 | 18.9 | 78.7 |
| 3 | Scottish Oil Shale | Toluene | 440 | 60 | 19.4 | 27.2 | 19.0 | 80.1 |
| 4 | Athabasca Tar Sands | Toluene | 395 | 30 | 11.0 | 30.8 | 9.3 | 88.0 |
| 5 | " | Pentane | 230 | 60 | — | — | 7.9 | 89.7 |

The analysis of the gas produced in the process is set out in Table 5.

TABLE 5

| | | | Gas extraction product analyses | | | | | | | | |
|---|---|---|---|---|---|---|---|---|---|---|---|
| Example No. | Substance | Product | % $H_2O$ ar | % Ash (db) | % (dry base) C | H | O | N | S | Cl | $CO_2$ |
| 1 | Colorado Oil Shale | Extract | — | — | 83.0 | 10.3 | 2.6 | 2.20 | 1.75 | 0.03 | — |
| | | Residue | 0.3 | 72.9 | 3.2 | 0.7 | — | — | — | — | 27.3 |
| 2 | Colorado Oil Shale | Extract | — | — | 83.4 | 10.2 | 2.3 | 2.25 | 1.60 | 0.05 | — |
| | | Residue | 0.3 | 75.6 | 1.9 | 0.30 | — | 0.15 | 0.65 | 0.03 | 21.5 |
| 3 | Scottish | Extract | — | — | 85.5 | 10.5 | 1.5 | 1.35 | 0.90 | 0.03 | — |

TABLE 5-continued

| Example No. | Substance | Product | Gas extraction product analyses % $H_2O$ ar | % Ash (db) | % (dry base) C | H | O | N | S | Cl | $CO_2$ |
|---|---|---|---|---|---|---|---|---|---|---|---|
| | Oil Shale | Residue | 0.7 | 85.9 | 7.8 | 0.8 | — | 0.40 | 1.00 | 0.02 | 0.75 |
| | | Extract | — | — | 84.0 | 10.3 | 1.3 | 0.40 | 3.85 | 0.09 | — |
| 4 | Athabasca Tar Sands | | | | | | | | | | |
| | | Residue | 0.3 | 98.4 | 0.5 | 0.1 | — | 0.02 | 0.10 | NIL | 0.28 |
| | | Extract | — | — | 83.2 | 10.6 | 1.2 | 0.30 | 4.25 | NIL | — |
| 5 | Athabasca Tar Sands | | | | | | | | | | |
| | | Residue | 0.2 | 97.8 | 1.25 | 0.20 | — | 0.05 | 0.15 | NIL | 0.07 |

The following Table 6 shows the high recovery of organic material achieved by gas extraction.

TABLE 6

| Example No. | Substance | Recovery of organic material Procedure | Tar or extract product % Total Organics | Organics in residue % Total Organics |
|---|---|---|---|---|
| 6 | Colorado Oil Shale | Gas extn. at 395° C. | 77 | 15 |
| 7 | Colorado Oil Shale | Gas extn. at 440° C. | 88 | 9 |
| 8 | Scottish Oil Shale | Gas extn. at 440° C. | 66 | 25 |
| 9 | Athabasca Tar Sands | Gas extn. with toluene | 89 | 5 |
| 10 | Athabasca Tar Sands | Gas extn. with pentane | 75 | 13 |

EXAMPLES 11 AND 12

Further samples of Colorado oil shale were extracted with supercritical methyl cyclohexane and with supercritical pyridine at 440° C. at a pressure of 1500 PSIG (10 NMM-2).

In the extraction with methylcyclohexane, the yield of extract was 16.4% of the dry shale. The residue contained 1.85% organic carbon. Thus only 8% of the organic matter in the shale, expressed in terms of its carbon content, remained in the spent shale after extraction with supercritical methyl cyclohexane.

In the extraction with pyridine, the yield of extract was 16.8% of the dry shale. The residue contained 1.4% carbon. Thus only 6% of the organic matter in the shale, expressed in terms of its carbon content, remained in the spent shale after extraction with supercritical pyridine.

EXAMPLE 13

A sample of Athabasca tar sands was extracted with supercritical tetrahydrofuran at 310° C. at a pressure of 1500 PSIG. The yield of extract obtained was 9.3% of the sand, i.e. equivalent to that obtained at 395° C. using supercritical toluene.

It will be appreciated from the foregoing, therefore, that the present invention provides a more efficient extraction of oil shales and tar sands than the various processes hitherto employed.

I claim:

1. A process for the extraction of oil shales and tar sands comprising heating the shale or sand in the presence of an extractant gas selected from the group consisting of ethylene,
carbon dioxide,
aromatic hydrocarbons having a single benzene ring,
aromatic hydrocarbon having a single benzene ring substituted with not more than 4 carbon atoms in a substituent group,
alicyclic hydrocarbon having at least 5 carbon atoms and not more than 12 carbon atoms,
aromatic hydrocarbon having 2 aromatic rings,
aliphatic hydrocarbon having at least 5 carbon atoms and not more than 16 carbon atoms,
phenol derived from an aromatic hydrocarbon having up to 8 carbon atoms,
alcohol,
aldehyde,
ketone,
ether,
ester,
aliphatic mono, di- and tri-amines having at least 4 and not more than 10 carbon atoms,
acyclic aliphatic amines and
aromatic amines having a benzene ring in the absence of externally supplied hydrogen to extract extractable constituents therefrom, separating the extractant and extract from the residue and recovering the extract from the extractant characterized in that the extractant is a gas phase extractant and the extraction is carried out at a temperature within the range of 0° to 550° C at a pressure not less than the critical pressure, the extractant being above its critical temperature by not more than 200° C and said temperature being within the range of 350° to 550° C when extracting oil shales.

2. A process as claimed in claim 1 wherein the extractant temperature is within the range of 350° to 550° C.

3. A process as claimed in claim 2 wherein the extraction is carried out at a temperature within the range of 370° to 450° C. and the shale or sand has a particle size such that 90% is less than 1.5 mm.

4. A process as claimed in claim 1 wherein the solvent/shale or sand ratio is within the ratio 1:1 to 30:1.

5. A process as claimed in claim 4 wherein the solvent/shale or sand ratio is within the range of 2:1 to 10:1.

6. A process as claimed in claim 1 wherein the extraction pressure is above the critical pressure and within the range of 500 to 10,000 psi.

7. A process as claimed in claim 6 wherein the extraction pressure is within the range of 1,000 to 3,000 psi.

8. A process as claimed in claim 1 wherein the material to be extracted is a tar sand and wherein the extraction is effected at a temperature of 80 to 150° C.

9. A process as claimed in claim 1 wherein the extractant is a solvent or utilisable solvent component which at the extraction temperature is above its critical temperature, the extraction being carried out at a pressure such that sum of the reduced partial pressures of the solvent components is at least 1.

10. A process as claimed in claim 1 wherein the extractant is selected from ethylene, carbon dioxide, aromatic hydrocarbons having a single benzene ring and, when substituted, not more than four carbon atoms in a substituent group.

11. A process as claimed in claim 1 wherein the extractant includes alicyclic hydrocarbon having at least five carbon atoms and not more than twelve carbon atoms.

12. A process as claimed in claim 1 wherein the extractant includes an aromatic hydrocarbon having two aromatic rings.

13. A process as claimed in claim 1 wherein the extractant includes aliphatic hydrocarbon having at least five carbon atoms and not more than sixteen carbon atoms.

14. A process as claimed in claim 1 wherein the extractant includes phenol derived from an aromatic hydrocarbon and having up to eight carbon atoms.

15. A process as claimed in claim 1 wherein the extractant includes one or more of alcohols, aldehydes, ketones, ethers and esters.

16. A process as claimed in claim 1 wherein the extractant includes amines including aliphatic mono, di- and tri-amines which have at least four, and preferably at least six carbon atoms, and not more than ten carbon atoms.

17. A process as claimed in claim 16 wherein the amines are selected from acyclic aliphatic amines, and aromatic amines having a benzene ring.

* * * * *